US005875525A

United States Patent [19]

Lee et al.

[11] Patent Number: 5,875,525

[45] Date of Patent: Mar. 2, 1999

[54] ZIPPER HEAD

[76] Inventors: Li-Hsin Lee, No. 4, Lane 101, Chang Hsin 1 St., Ta-Li City, Taichung Hsien; Shhi Chang Lin, No. 102, Lane 222, Hsin Chung Road, Ho Mei Chen, Chang Huw Hsien; A-Shin Chen, No. 56, Lane 26, Fu Jeng Road, Fu Hsin Hsian, Chang Huw Hsien, all of Taiwan

[21] Appl. No.: 3,688

[22] Filed: Jan. 7, 1998

[51] Int. Cl.[6] ..... A44B 19/26

[52] U.S. Cl. ..... 24/429

[58] Field of Search ..... 24/429, 430, 431

[56] References Cited

U.S. PATENT DOCUMENTS 4,920,615 5/1990 Aoki et al. ..... 24/429
5,093,966 3/1992 Yuki et al. ..... 24/429

*Primary Examiner*—James R. Brittain
*Attorney, Agent, or Firm*—Browdy and Neimark

[57] ABSTRACT

A zipper head is composed of a head, a pull tab connected with the head, and an elastic piece. The pull tab is provided with an insertion slot, a hooked portion and a cross beam. The elastic piece of a U-shaped construction has a first arm, a second arm, a curved portion connected with the first arm and the second arm, and an urging portion located between the first arm and the second arm. The elastic piece is joined with the pull tab such that the first arm of the elastic piece is retained in the insertion slot of the pull tab, and that the curved portion of the elastic piece is disposed on the cross beam of the pull tab, and further that the second arm of the elastic piece seals off an open end of the hooked portion of the pull tab, and still further that the urging portion of the elastic piece urges the cross beam of the pull tab.

3 Claims, 2 Drawing Sheets

ZIPPER HEAD

FIELD OF THE INVENTION

The present invention relates generally to a zipper, and more particularly to a head of the zipper.

BACKGROUND OF THE INVENTION

As shown in FIG. 1, a zipper head 10 of the prior art consists of a head 12, a pull tab 13 fastened at one end thereof with the head 12, and a pull member 14 fastened at one end thereof with another end of the pull tab 13 to facilitate the pulling of the head 12. The pull member 14 has a retaining ring 15, whereas the pull tab 13 has a retaining hook 16, which is engaged with the retaining ring 15. Such a prior art zipper head 10 as described above is defective in design in that the retaining hook 16 is relatively small and can not be easily made by a molding tool, thereby resulting in a relatively high rejection rate.

As shown in FIGS. 2 and 3, another prior art zipper head 20 consists of a head 20, and a pull tab 23 having a hooked portion 24. Located between the hooked portion 24 and a cross beam 25 of the pull tab 23 is an insertion slot 26, as shown in FIG. 3. The insertion slot 26 is intended to locate an arm 271 of a U-shaped elastic piece 27 such that the curved portion 273 is connected with the cross beam 25, and that another arm 272 of the elastic piece 27 serves to close the opening of the hooked portion 24. This prior art zipper head 20 is defective in design in that the elastic piece 27 is not located securely and is thus vulnerable to falling out of the slot 26. To overcome such a deficiency as described above, the cross beam 25 is provided with two protruded portions 28, as shown in FIG. 2, for riveting the curved portion 273 of the elastic piece 27. The addition of the two protruded portions 28 is responsible for an increase in the cost of making the zipper head 20 without improving the quality of the zipper head 20. In addition, the elastic piece 27 can not be held securely by riveting in view of the fact that the two protruded portions 28 are relatively small and can not be securely riveted. In other words, the addition of the two protruded portions 28 complicates the process of making the zipper head 20 without resulting in a meaningful improvement in the quality of the zipper head 20.

SUMMARY OF THE INVENTION

The primary objective of the present invention is therefore to provide an improved zipper head free from the shortcomings of the prior art zipper heads described above.

The objective, features, functions, and advantages of the present invention will be readily understood upon a thoughtful deliberation of the following detailed description of a preferred embodiment of the present invention with reference to the accompanying drawings.

DETAILED DESCRIPTION OF THE INVENTION

Figure 4:
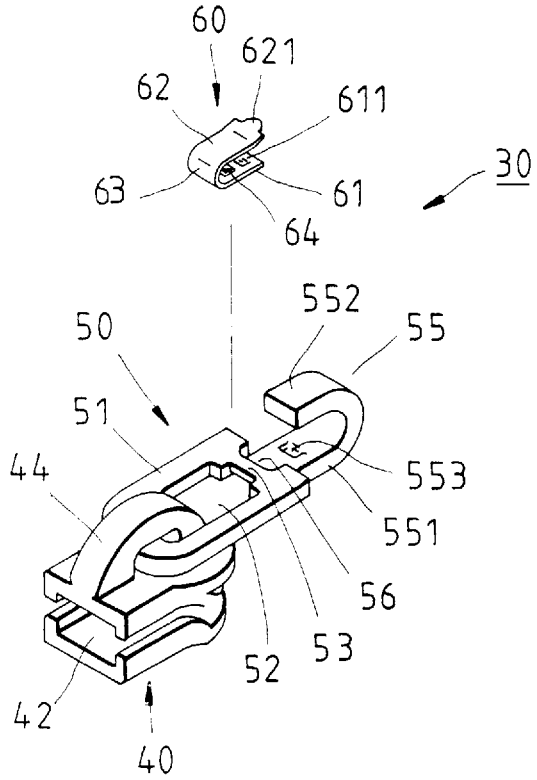
FIG. 4 shows a partial exploded view of the present invention.
Figure 5:
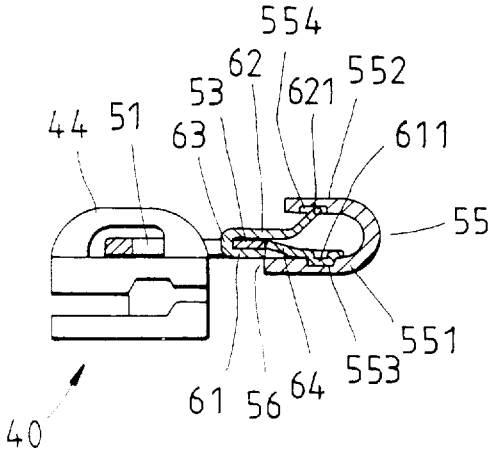
FIG. 5 shows a partial longitudinal sectional view of the present invention in combination.

As shown in FIGS. 4 and 5, a zipper head 30 embodied in the present invention is composed of a head 40, a pull tab 50, and an elastic piece 60.

The head 40 is provided with a channel 42 extending along the direction of the longitudinal axis of the head 40 to accommodate a zipper chain. The head 40 of the present invention is basically similar in construction to the head of the prior art zipper head.

The pull tab 50 has a flat body 51 which is provided with a through hole 52, a cross beam 53 located at one end of the flat body 51, and a U-shaped hooked portion 55 corresponding in location to the cross beam 53. The hooked portion 55 has a fastening end 51. Located between the cross beam 53 and the fastening end 551 is an insertion slot 56, as shown in FIG. 5. The hooked portion 55 is provided at another end thereof with an open end 552 which is separated from the flat body 51 by a distance. The fastening end 551 of the hooked portion 55 is provided in the inner wall thereof with a retaining portion 553, whereas the open end 552 of the hooked portion 55 is provided in the inner wall thereof with a retaining portion 554. The pull tab 50 is connected with a connection portion 44 of the head 40.

The elastic piece 60 of a U-shaped construction is composed of two arms 61, 62, and a curved portion 63 from which the two arms 61 and 62 extend. The arm 61 is provided with an urging portion 64 located between the arms 61 and 62. The urging portion 64 is made integrally with the arm 61 by punching and pressing. The urging portion 64 has a free end facing the curved portion 63 of the elastic piece 60. The free end of the arm 61 has a first retaining portion 611, whereas the free end of the arm 62 has a second retaining portion 621.

In combination, the arm 61 of the elastic piece 60 is lodged in the insertion slot 56 of the pull tab 50 such that the curved portion 63 is disposed on the cross beam 53, and that the first arm 61 is in contact with the fastening end 551 of the hooked portion 55. In the meantime, the second arm 62 is in contact with the open end 552 of the hooked portion 55 such that the opening of the hooked portion 55 is closed. As the elastic piece 60 is located, the cross beam 53 is urged by the urging portion 64. The retaining portions 611 and 621 of the elastic piece 60 are engaged securely with the retaining portions 553 and 554 of the pull tab 50.

Figure 1:
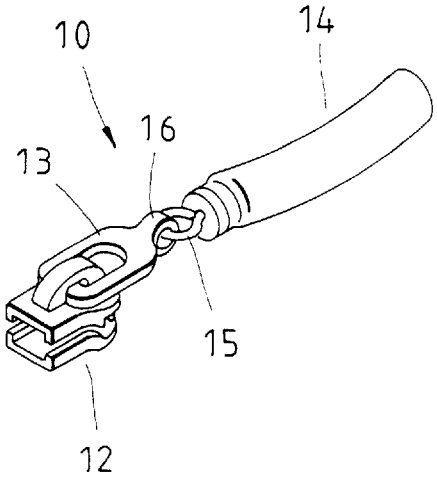
FIG.1 PRIOR ART
FIG. 1 shows a perspective view of a prior art zipper head.
Figure 2:
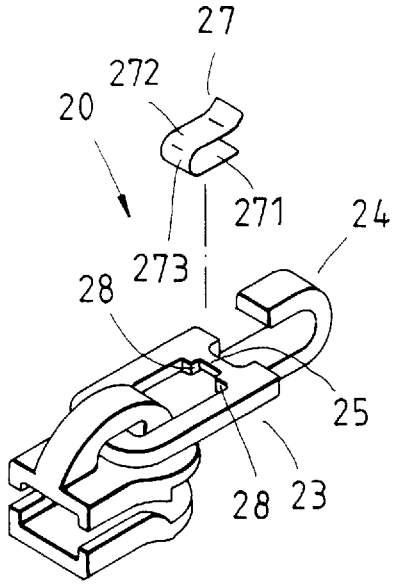
FIG. 2 PRIOR ART
FIG. 2 shows a partial exploded view of another prior art zipper head.
Figure 3:
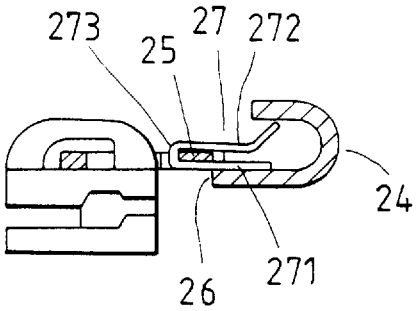
FIG. 3 PRIOR ART
FIG. 3 shows a sectional view of the of prior art zipper head FIG. 2 in combination

A pull member, as shown in FIG. 1, can be attached to the present invention by using the retaining ring of the pull member to urge the second arm 62 of the elastic piece 60 until such time when a gap is formed between the second arm 62 and the open end 552 of the hooked portion 55. The retaining ring of the pull member can be then inserted into the hooked portion 55 via the gap.

The process of joining the elastic piece 60 with the pull tab 50 of the present invention is not hampered by the urging portion 64. The elastic piece 60 is joined with the pull tab 50 such that the urging portion 64 urges the cross beam 53 of the pull tab 50 so as to prevent the elastic piece 60 from being separated from the pull tab 50. The elastic piece 60 is joined with the pull tab 50 without the use of rivets.

What is claimed is:

1. A zipper head comprising:

a head provided with a channel extending along the direction of a longitudinal axis thereof for accommodating a zipper chain, said head further provided at a top thereof with a connection portion;

a pull tab having a body provided with a through hole and a cross beam located at one end of said body, said body further provided with a U-shaped hooked portion having a fastening end and an open end, said pull tab further having an insertion slot located between said fastening end of said hooked portion and said cross beam, said through hole of said pull tab being engaged with said connection portion of said head; and an elastic piece of a U-shaped construction and having a first arm, a second arm, and a curved portion connected with said first arm and said second arm, said elastic piece being engaged with said pull tab such that said first arm is retained in said insertion slot of said pull tab, and that said open end of said hooked portion is sealed off by said second arm, and further that said curved portion is disposed on said cross beam;

wherein said elastic piece has an urging portion located between said first arm and said second arm; and wherein said elastic piece is engaged with said pull tab such that said urging portion of said elastic piece pressed against said cross beam of said pull tab.

2. The zipper head as defined in claim 1, wherein said urging portion is made integrally with said first arm by punching and pressing such that said urging portion has a free end facing said curved portion of said elastic piece.

3. The zipper head as defined in claim 1, wherein said fastening end of said hooked portion is provided in an inner wall thereof with a retaining portion; and wherein said first arm of said elastic piece is provided with a retaining portion engaged with said retaining portion of said hooked portion.

* * * * *